US005123657A

United States Patent [19]

Colt et al.

[11] Patent Number: 5,123,657

[45] Date of Patent: Jun. 23, 1992

[54] ARROW FOR USE BY A BOW HUNTER FOR ATTRACTING GAME

[76] Inventors: Larry D. Colt, 14503 S. Garnett, Broken Arrow, 74012; Lawrence L. Moore, 4867 S. 85th East Ave., Tulsa, both of Okla. 74145

[21] Appl. No.: 805,195

[22] Filed: Dec. 9, 1991

[51] Int. Cl.[5] ..... F42B 6/08

[52] U.S. Cl. ..... 273/418; 273/419

[58] Field of Search ..... 273/418, 419

[56] References Cited

U.S. PATENT DOCUMENTS

| | | | |
|---|---|---|---|
| 2,617,359 | 11/1952 | Van Horn et al. | 273/418 X |
| 4,093,229 | 6/1978 | Kelling | 273/418 |
| 4,726,584 | 2/1988 | Bishop | 273/418 |
| 4,881,743 | 11/1989 | Fiorenzo | 273/418 |
| 5,033,220 | 7/1991 | Phelps | 273/419 X |
| 5,033,446 | 7/1991 | Bradt | 273/418 X |

*Primary Examiner*—Paul E. Shapiro
*Attorney, Agent, or Firm*—Head & Johnson

[57] ABSTRACT

An arrow for use by a bow hunter for attracting game, such as a deer, toward the hunter, the arrow being in the form of an elongated tubular arrow shaft, a closure member removably attachable to the shaft forward end, the closure member having a sharp pointed blade extending therefrom and internally within the tubular arrow shaft when the closure member is attached to the arrow shaft, a cylinder cartridge sidably receivable within the arrow shaft for containing game attracting scent producing liquid therein, and a line attached to the arrow shaft adjacent the rearward end so that when a hunter shoots the arrow, the cartridge within the arrow is impacted against the sharp pointed blade when the arrow strikes the earth's surface or other object, penetrating the cartridge to release the scent producing liquid therefrom which is drained from within the tubular arrow shaft to the exterior thereof, the scent being spread upon the earth's surface as the arrow is retrieved by retrieval of the line by the bow hunter.

8 Claims, 1 Drawing Sheet

ARROW FOR USE BY A BOW HUNTER FOR ATTRACTING GAME

BACKGROUND OF THE INVENTION

A popular sport in the United States is bow hunting. Most areas of the United States and other countries of the world which have large population of animals, such as deer, wild turkey or the like, have specific hunting days set aside limited for use by bow hunters. In addition, bow hunting is typically permitted during times that also permit hunting with guns.

A typical means of hunting for large game animals, such as deer, is for the hunter to position himself in a tree, or other high elevation, in an area frequented by the game. From this vantage point, the hunter can then wait for the approach of the game. Obviously, a problem for the hunter is attracting game to move in the direction in which the hunter has stationed himself. It has long been known that animals, and particularly game animals, are acutely sensitive to odor, and particular odor produced by animals of the same species. For this reason, it has been a practice to utilize animal attracting scent in the hunting of animals and such scent is readily commercially available. The scent is in liquid form and may be dispensed in a variety of ways for attracting the attention of the animals to be hunted and when the scent is spread on the earth's surface, it can be useful in causing animals to move in the direction most favorable for the hunter.

One problem with the use of liquid scent in hunting is that it is difficult to place and spread the scent without also spreading the scent of the hunter. If the animal to be attracted is aware of the presence of a hunter, or any other scent to which the animal is not accustom, the effectiveness of the commercially prepared scent in attracting animals to move in a preferred direction is substantially reduced. For this reason, others have provided arrows that can be used for dispensing scent producing liquids. As an example U.S. Pat. No. 4,881,743 entitled "Scent Head Arrow" provides an arrow having a large scent head container affixed to the forward end thereof. The scent head container includes a fibrous scent filled carrier that can contain animal scent. A problem with the scent head arrow of U.S. Pat. No. 4,881,743 is that the scent must be applied by the hunter to the fibrous material and in the process it is difficult for the hunter also to not impart some of his own scent to the arrow. Further, this requires the hunter to carry with him a container of the liquid scent that must be opened and utilized immediately to launching of the arrow.

U.S. Pat. No. 3,528,662 entitled "Material Dispensing Projectile" discloses a concept of a projectile that can be launched or fired and has means at the forward end of the projectile for dispensing a scent upon contact. The projectile of this disclosure, however, is not adaptable for use by a bow hunter, that is, the projectile is not adaptable to be used in the form of an arrow. Further, the apparatus disclosed in this patent is fairly complex and expensive to manufacture.

U.S. Pat. No. 4,726,584 discloses a scent releasing arrow wherein a pad is soaked with liquid scent. The pad is placed within a tubular arrow and a sleeve is placed over the arrow. The arrow is then fired and the sleeve is displaced exposing the liquid soaked pad. The system of this disclosure provides no means of positively releasing a liquid scent upon impact of the arrow nor a means whereby the liquid scent can be carried in cartridges but, instead, requires the hunter to pour the liquid scent from a container to saturate the material within the arrow.

The present disclosure overcomes the disadvantages of the prior art exemplified by these three previously issued United States patents and provides an improved arrow for use by a bow hunter for attracting game.

SUMMARY OF THE INVENTION

The invention of this disclosure is an arrow for use by a bow hunter for attracting game, such as deer, toward the hunter.

The arrow is in the form of an elongated arrow shaft having a forward end and a rearward end. The arrow shaft has a tubular portion adjacent to the forward end. In the practical embodiment of the invention the entire arrow shaft may be tubular, such as formed out of tubular metal like aluminum or aluminum alloys or other metals or alloys having similar characteristics.

A closure member is removably attached to the forward end for opening and closing the tubular portion of the arrow shaft. The closure member may be in the form of a tubular collar that is fitted to the forward end of the arrow shaft, the collar having internal threads. The closure member has external threads that are threadably receivable in the collar member so that by unthreading the closure member, the tubular interior of the arrow shaft is exposed.

The closure member also preferably functions as the head of the arrow and is preferably provided with a blunt forward surface so that the arrow, upon engaging the earth's surface, a tree or any other object, does not penetrate the object. In order to further resist penetration, and particularly to resist the arrow penetrating into grass, weeds or the like, the closure member preferably has a head portion that includes grass catcher wires extending outwardly therefrom.

Affixed to the end of the closure member extending internally within the tubular end portion of the arrow shaft is a sharp pointed member, such as a blade.

The closure member has a small diameter passageway therein providing communication between the arrow shaft tubular portion and the exterior of the tubular portion.

The rearward end of the arrow shaft has aerodynamic stabilizing means, such as radially extending spaced apart fins, to assist in guidance of the arrow after it is shot. A flexible line is attached to the rearward end portion of the arrow shaft.

Slidably positioned within the interior of the arrow shaft tubular end portion is a cylindrical cartridge containing game attracting scent producing liquid.

The rearward end of the arrow shaft is provided with a nock that receives the bow string as the arrow is launched by a bow hunter. The arrow is used in this manner. The hunter, positioned in an area favorable to receive the passage of game to be hunted, such as deer, desires to increase the possibility of game animals being attracted to the vicinity of where the hunter is stationed. As an example, much deer hunting is accomplished by a hunter positioned in a tree at an elevated location so that the hunter can see the deer approaching from further distances and so as to be less likely observed by the deer. If the hunter wishes to improve the possibility of attracting deer to come near his location, he can shoot the scent arrow toward a point positioned at a distance from his location and a point likely to be visited by one or more game animals. The tubular cartridge of scent producing liquid rides within the arrow during its flight. When the arrow contacts the earth's surface, or other solid physical object, the scent cartridge is carried forward by its inertia to impinge upon the sharp pointed member protruding from the closure member within the tubular portion of the arrow. This causes the cartridge member to be punctured, releasing the scent producing liquid. The liquid flows from the cartridge into the interior of the arrow shaft tubular portion. The scent producing liquid continues to flow out through the passageway within the closure member to the exterior of the arrow, that is, to the earth's surface or an object adjacent to the arrow on the earth's surface.

As the hunter shoots the arrow to a remote location, line uncoils from a spool attached to his bow. Thus, the hunter has access to the line after the arrow is shot. The hunter can then retrieve the arrow. If the arrow has landed in the proper position, the hunter will slowly retrieve the arrow, allowing the scent producing liquid to pass out of the interior portion of the arrow shaft to be deposited on the earth's surface or on objects, such as leaves, grass and so forth, growing from the earth's surface.

The scent producing liquid selected for inclusion in the cartridge will be of the type that promises attraction of the species being hunted. For instance, if the hunter is seeking deer, then the liquid scent producing material that is characteristic of deer is commercially available. The hunter can carry any number of cartridges and is never required to carry a large container having a quantity of liquid that must be deposited on some portion of an arrow, such as illustrated in U.S. Pat. Nos. 4,726,584 and 4,881,743. Further, the arrow is of substantially the identical configuration as used for hunting purposes and fits comfortably and easily in a quiver. The cartridges of scent producing liquid can easily be wiped to remove all human or other scents before insertion into the arrow so that the animal attracting scent can be deposited and spread along a path on the ground without the presence of the human being, which would otherwise entail the introduction of detracting scent.

A better understanding of the invention will be had by reference to the following description and claims, taken in conjunction with the attached drawings.

DESCRIPTION OF THE PREFERRED EMBODIMENT

Figure 1:
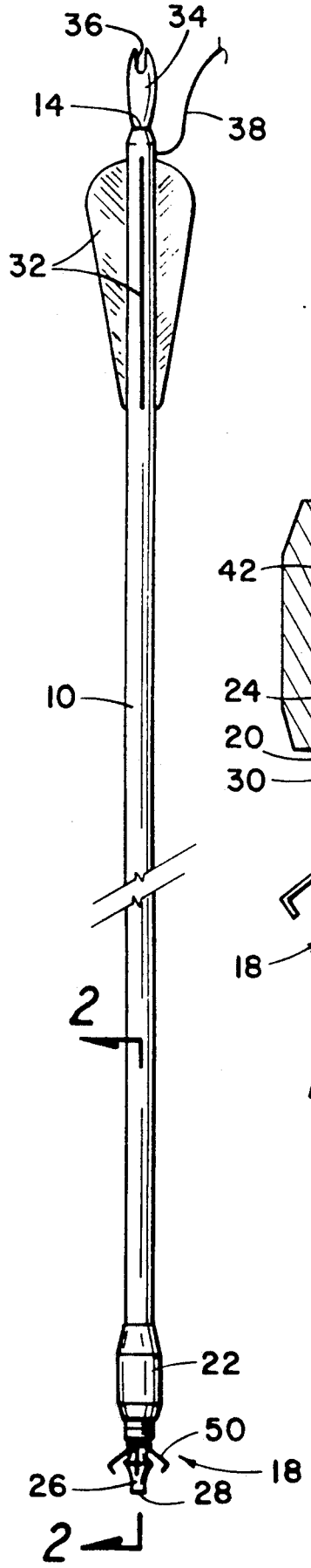
FIG. 1 is an elevational broken away view of an arrow for use by a bow hunter for attracting game that employs the principles of this disclosure.
Figure 2:
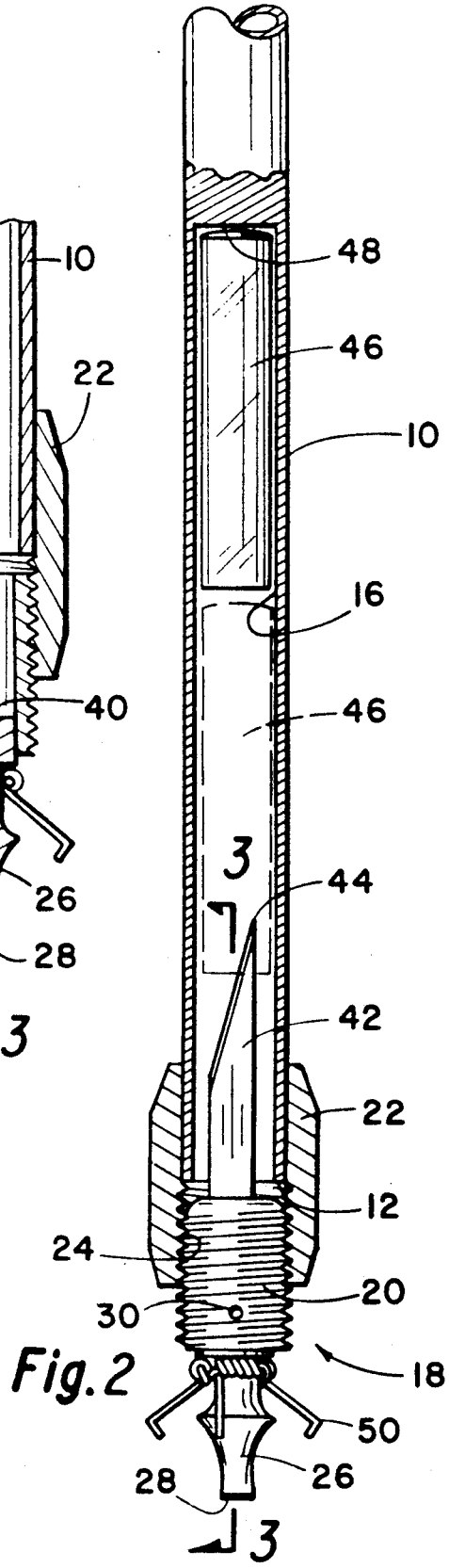
FIG. 2 is an enlarged partial cross-sectional view of the arrow forward end portion taken along the line 2—2 of FIG. 1.

Referring to the drawings and first to FIG. 1, the external appearance of an arrow that incorporates the principles of this invention is shown. The arrow includes an elongated arrow shaft 10 having a forward end 12, as seen in FIG. 2, and a rearward end 14, as seen in FIG. 1. The arrow shaft 10 may preferably be formed of a length of tubular metal so that the shaft is tubular throughout substantially the whole length but, in any event, arrow shaft 10 has, adjacent to forward end 12, a tubular portion 16.

Figure 3:
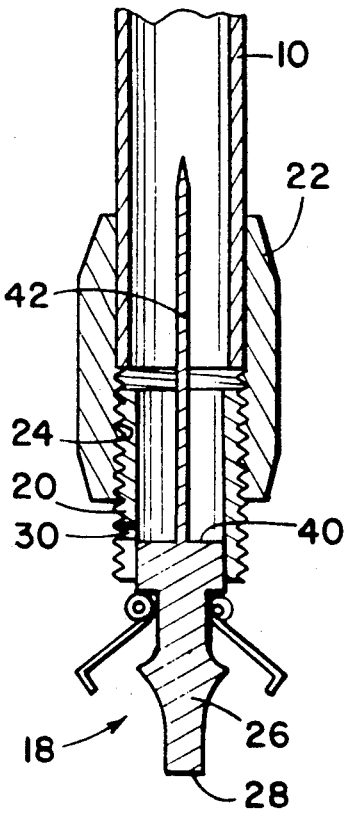
FIG. 3 is a partial cross-sectional view of the closure member with the blade attached thereto as taken along the line 3—3 of FIG. 2 showing the internal construction of the closure member and blade that is removable and insertable into the forward end of the arrow shaft.

At the forward end of the arrow shaft is a closure member, generally indicated by the numeral 18, that is removably attachable to arrow shaft 10. As illustrated in FIGS. 2 and 3, closure member 18 is formed of a tubular portion 20 that has external threads throughout the full length thereof. A tubular collar 22 is received on the forward end portion of arrow shaft 10 and may be secured such as by bonding, brazing or otherwise attaching the tubular collar to the arrow shaft. The forward end of tubular collar 12 is internally threaded at 24 and thus threadably receives threaded tubular portion 20. Received in the outer end of the threaded tubular member 20 is a head member 26. The head member may be bonded, brazed or otherwise secured to the threaded tubular member 20. Head member 26 has a forward end surface 28 that is blunt. Thus, the arrow of this disclosure is not intended for penetrating game for hunting purposes or any other object, but blunt forward end 28 of the arrow ensures immediate stoppage of flight when the arrow encounters the earth's surface or other object.

The threaded tubular member 20 has a small diameter weep hole opening 30 therein for purposes to be described subsequently.

Turning back to FIG. 1, adjacent to arrow shaft rearward end 14 are arrow aerodynamic stabilizing vanes 32 that are representative of a typical arrow and serve to assist in guidance of the arrow in flight. At the arrow rearward end 14 is a nock 34, that is also typical of arrows, and has a slot 36 therein for receiving a bow string.

Attached to arrow shaft 10 adjacent to rearward end 14 is a line 38. The line may be attached by an opening through the arrow shaft. Line 38 extends to a reel (not shown) mounted as a part of a bow (not shown) when the arrow is launched. As the hunter fires the arrow, line 38 travels with the arrow and serves as a means of retrieving the arrow.

Affixed to head member 26 at the rearward end 40 is a blade 42 having a sharp point 44.

Slidably received within arrow shaft tubular portion 16 is a scent cartridge 46. The scent cartridge 46 is formed of penetrable material, such as plastic, and contained within the cartridge is a scent producing liquid that is of the type that attracts the game animal the hunter seeks. Such scent producing liquid is readily commercially available and is frequently employed for hunting purposes.

The external diameter of the sealed scent cartridge 46 is less than the internal diameter of arrow shaft tubular portion 16 so that the scent cartridge is slidable within the tubular portion.

The hunter uses the arrow of this disclosure in this manner. The hunter positions himself in a favorable location for the passing of game being hunted, such as deer. Frequently a game hunter utilizing a bow seeks large game, such as a deer, by positioning himself within an elevated location, such as a tree.

After the hunter has positioned himself in a favorable location and desires to increase the chance of attracting the game animal to approach his location, the hunter fires the arrow illustrated in FIG. 1 toward a remote location where the game animal is likely to pass. When the arrow is launched, line 38 is unreeled and follows the arrow. When the arrow is launched, scent cartridge 46 is moved to the rearward end of the arrow shaft tubular portion 16 and buttes against a stop 48. When the arrow has only a short length tubular portion 16, stop 48 may be simply the material which the arrow is formed of and which has not been removed to form the tubular portion. On the other hand, in a preferred arrangement the entire shaft portion 10 is tubular and stop 48 may thus be formed by inserting an object within the tubular arrow shaft to form stop 48, or a pin can be mounted in holes drilled directly through the arrow shaft. In any event, tubular portion 16 has a rearward end stop against which scent cartridge 46 rests as the arrow is launched.

The position of the scent cartridge 46 when the arrow is launched is indicated in solid outline in FIG. 2.

When the arrow strikes an object, such as the earth's surface, a tree or the like, the arrow suddenly stops due to blunt end 28. The arrow does not penetrate into the earth's surface or any other object, penetration is avoided by blunt surface 28. When the arrow suddenly stops upon impact with the earth's surface, a tree, or other object, scent cartridge 46 is displaced rapidly forwardly by inertia to the position indicated by dotted outline in FIG. 2. Scent cartridge 46 encounters sharp end 44 of blade 42, penetrating the scent cartridge to thereby permit the liquid scent producing material therein to escape from the scent cartridge.

The liquid scent material moves from scent cartridge 46 into arrow shaft tubular portion 46 and exterior of the arrow shaft through weep hole 30. Thus, scent producing liquid from the cartridge is passed out of the cartridge into the exterior of the arrow where it can contact the earth's surface, grass, brush and other objects adjacent to the arrow.

The blunt forward end 28 of head member 26 has been described and the purpose thereof for preventing the penetration of the arrow has been explained. To further prevent the arrow from traveling deep within grass, brush or the like where the arrow may be difficult to retrieve, a grass catcher 50 may be employed. The grass catcher 50 is in the form of wire twisted and formed about head member 26 with radially extending portions, as illustrated, which spring out and catch upon grass, brush or the like. The radially outwardly extending wire portions are bent at the outer ends to further catch upon grass or other objects and to thereby stop the arrow as quickly as possible when a physical object is engaged.

After the arrow has been launched and suddenly stopped by the contact of the head portion with the earth's surface or some other object and scent cartridge 46 has been penetrated to permit the scent producing liquid to leak therefrom, the bow hunter can then slowly retrieve the arrow by retrieving line 38, pulling the arrow toward the direction of his location. As the arrow is slowly retrieved scent producing liquid will be leached from cartridge 46 and out through weep hole 30 to leave a scent trail from the point where the arrow first landed in the direction toward the hunter's location. When the hunter launches the arrow from a tree mounted position, the arrow can be lifted up to the tree and reused.

To reuse the arrow the hunter merely unthreads closure member 28, which removes with it blade 22. This leaves arrow shaft 10 open and scent cartridge 46 can be immediately removed by holding the arrow upwardly and letting gravity move the scent cartridge out of the open end of the arrow. A new scent cartridge may be inserted. Since the scent cartridge is a small closed plastic container, it can be easily wiped clean of any scents that would be damaging, such as the scent of the hands of the user, as the cartridge is inserted into the open end of the arrow shaft. After the cartridge is inserted, closure member 18 is threaded back into position and the arrow is ready to be used again. Thus, the hunter can launch the arrow in several different directions and create scent trails in the direction of his location.

The bow hunter need carry only a single arrow and a plurality of scent cartridges 46. Thus, the hunter does not have to employ a container from which liquid must be dispensed into or on some other object for the purpose of repeatedly using the arrow from a single hunting location.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An arrow for use by a bow hunter for attracting game, such as deer, towards the hunter, comprising:

an elongated arrow shaft having a forward and a rearward end, the arrow shaft having a tubular portion adjacent to the forward end;

a closure member removably attachable to said forward end for opening and closing said tubular portion and having a passageway therein providing communication between said tubular portion and the exterior of said closure member;

a sharp pointed member removably extending within said arrow shaft tubular end portion;

a cartridge slidably receivable within said arrow shaft tubular end portion having means for containing game attracting scent producing liquid therein; and a line attached to said arrow shaft adjacent to said rearward end whereby said arrow shaft may be shot, such as from a bow, and upon said arrow shaft forward end striking an object such as the earth's surface said cartridge is urged by inertia against and is penetrated by said sharp pointed member causing release of game attracting scent producing liquid, which liquid passes through said passageway in said closure member to spread upon the earth's surface and in which the area of scent spread may be extended toward the hunter as said line is retrieved by the hunter.

2. An arrow for use by a bow hunter for attracting game according to claim 1 wherein said closure member has a blunt forward end that, when said closure member is received in said arrow shaft tubular end portion, forms the forward end of the arrow and the blunt end prevents the arrow from penetrating the earth's surface or other object which the arrow may encounter when shot by a bow hunter.

3. An arrow for use by a bow hunter according to claim 2 including a grass catcher means affixed to said closure member.

4. An arrow for use by a bow hunter for attracting game according to claim 1 including:

a tubular collar member having a forward and a rearward end and having the rearward end affixed to said arrow shaft forward end, the collar member forward end being internally threaded and said closure member being externally threaded and receivable within said collar member.

5. An arrow for use by a bow hunter according to claim 4 wherein said sharp pointed member is secured to said closure member and is removed from said arrow shaft tubular end portion as said closure member is removed.

6. An arrow for use by a bow hunter according to claim 1 wherein said cartridge is cylindrical and of external diameter less than the internal diameter of said arrow shaft tubular portion.

7. An arrow for use by a bow hunter according to claim 1 including aerodynamic stabilizing means affixed to said arrow shaft adjacent to said rearward end thereof.

8. An arrow for use by a bow hunter according to claim 1 wherein said arrow shaft is tubular through at least a substantial portion of the length thereof and including means to limit the length of said cartridge receiving tubular portion adjacent to said arrow shaft forward end.

* * * * *